United States Patent [19]

Weller et al.

[11] Patent Number: 5,026,038

[45] Date of Patent: Jun. 25, 1991

[54] SIGNATURE FEEDER OPERABLE WITH EITHER FLAT OR STANDING STACKS

[75] Inventors: Ronald W. Weller, Orland Park; James Wrona, Burbank, both of Ill.

[73] Assignee: McCain Manufacturing Corporation, Chicago, Ill.

[21] Appl. No.: 524,730

[22] Filed: May 17, 1990

[51] Int. Cl.[5] ..... B65H 5/22

[52] U.S. Cl. ..... 271/3.1; 271/4; 271/5; 271/12; 271/31.1; 271/150; 271/163; 271/165; 271/272; 271/276; 271/213

[58] Field of Search ..... 271/3.1, 4, 5, 6, 94, 271/95, 99, 225, 149–151, 213, 214, 216, 105, 31.1, 34.35, 272, 277, 157, 162, 163, 165, 275, 276

[56] References Cited

U.S. PATENT DOCUMENTS

| | | | |
|---|---|---|---|
| 2,163,145 | 6/1939 | Johnson | 271/10 |
| 3,051,333 | 8/1962 | Richert et al. | 271/3.1 |
| 3,334,890 | 8/1967 | Bombard | 271/199 X |
| 3,643,939 | 2/1972 | Nussbaum et al. | 271/10 X |
| 3,870,294 | 3/1975 | Donner | 271/3.1 |
| 3,918,143 | 11/1975 | Groshon | 271/10 X |
| 4,177,982 | 12/1979 | Bewersdorf et al. | 271/6 X |
| 4,775,140 | 10/1988 | Foster | 271/149 X |
| 4,795,297 | 1/1989 | Tokuno et al. | 271/151 X |
| 4,907,791 | 3/1990 | Higgins et al. | 271/94 X |

FOREIGN PATENT DOCUMENTS

| | | | |
|---|---|---|---|
| 152503 | 8/1985 | European Pat. Off. | 271/3.1 |
| 175629 | 10/1982 | Japan | 271/157 |

*Primary Examiner*—Robert P. Olszewski
*Assistant Examiner*—Boris Milef
*Attorney, Agent, or Firm*—Kinzer, Plyer, Dorn, McEachran & Jambor

[57] ABSTRACT

Signature loader comprising a telescopically related main floor-mounted frame and a smaller auxiliary frame, first and second horizontal rotatable shafts between the frames spaced apart by a predetermined distance and so positioned that infeed belts thereon converge to define between them a signature infeed throat, one of said shafts being a pivot about which the auxiliary frame may be pivoted so the throat may be selectively positioned in one of two alternate attitudes.

5 Claims, 2 Drawing Sheets

SIGNATURE FEEDER OPERABLE WITH EITHER FLAT OR STANDING STACKS

This invention relates to signature machines, and in particular to a signature loader at a supply station where the signatures are removed sequentially and fed in a stream from that station to a signature discharge or unloading station, the second station, in most instances, being a so-called pocket feeder (hopper) from which the unloaded signatures are extracted and fed one by one to the signature gatherer to be collected with other signatures fed to the gatherer in like manner to complete a book.

BACKGROUND OF THE INVENTION

Signatures to be gathered either on a saddle conveyor or flat gatherer, eventually fed to the conveyor out of a pocket feeder, are received from the binder in a heavy, strap-bound pack. The pack is opened and the signatures arranged as a loose pack in a loader, representing the main supply. The signatures are withdrawn one by one from the supply loader and advanced as a stream to the ultimate pocket feeder where they are extracted one by one and collected on the gatherer sequentially one atop another, to complete the book.

One form of signature feeding machine for accomplishing this is disclosed in U.S. Pat. No. 4,177,982 granted to McCain Manufacturing Corp., the present assignee. In this form of machine, the signatures constituting the main supply are stacked on edge in the loader, the backbone down, like so many fence posts, one behind the other.

In another form, the signatures constituting the main supply are stacked flat, one atop another, like a deck of cards. This form is disclosed in U.S. Pat. No. 4,907,791, granted to the present assignee.

These feeders are extremely expensive. The binder company which purchases the feeders may require as many as one hundred, collectively involving a cost of well over one million dollars. Unfortunately, the bindery attendants do not always know in which form the bound signatures will arrive from the printer, usually a 30" stack. The signatures may arrive on a pallet in the fence-post array (horizontal pack) or they may be palletized as a vertical stack like a deck of cards, wire bound with end boards which have to be removed in either case.

The horizontal stack (U.S. Pat. No. 4,177,982) is easier to place or insert in a loader having feed belts substantially horizontal; the stack is simply raised by a forklift or hoist, the straps and end boards removed, and the stack lowered carefully onto the conveyor belts of the feeder. One trip only is required to unload the stack.

In comparison, if the stack is vertical, then the feeder is of different form, U.S. Pat. No. 4,907,791. In this instance, the signatures must be hand loaded piecemeal: repeated 6" hand-held bundles for example, placed in the loader one atop another until the pallet is emptied, involving several trips, or several attendants to service the job.

Therefore, to cope with both possibilities, the bindery needs to stock both kinds of feeders, constituting a considerable expense, to say nothing of the storage space which must be accorded.

The primary object of the present invention is to construct a unitized signature feeder which will serve both circumstances, either for signatures set on edge in the loader, backbone down, or set flat one atop another.

SUMMARY OF THE PRESENT INVENTION

Under and in accordance with the present invention, a signature loader for feeding signatures between a supply station and an unloading station is constructed to include a telescopically related main floor-mounted frame and a smaller auxiliary frame. First and second horizontal rotatable shafts are supported transversely by and between both frames with the axes of the shafts spaced apart by a predetermined distance. The shafts respectively support opposed rollers for opposed signature infeed belts and are so positioned that belts converge to define between them an infeed entry bight or throat into which the signatures are to be fed one by one from the supply and advanced by the belts in the direction of the unloading station. One of the shafts constitutes a pivotal axis about which the auxiliary frame may be pivoted so that the throat may be selectively positioned in one of two alternate attitudes to receive signatures by either a substantially vertical drop one after the other into the throat or by a substantially horizontal movement of the signatures one after the other into the throat. The two frames are rigidly joined by a manually settable lock with the throat located in one attitude; upon releasing the lock the auxiliary frame may be turned on the shaft axis to locate the throat in its other attitude. The distance between the shafts does not change when the auxiliary frame is pivoted or turned, only their radial attitude or angle.

Additionally, the auxiliary frame supports a third transverse shaft on which is located a third roller spaced from and associated with the roller on the first shaft with one of the infeed belts supported by and between the first and third rollers. The main frame supports a fourth transverse shaft on which is located a fourth roller spaced from and associated with the second shaft with the other of the infeed belts supported by and between the second and fourth rollers. Again, the distance separating these shafts does not change when the auxiliary frame is pivoted.

Preferably, the infeed belt supported by and between the rollers on the first and third shafts is apertured with the apertures communicating with a source of negative pressure, capturing the supply signatures successively by suction to feed the signatures to the belt throat.

DETAILED DESCRIPTION

Figure 1:
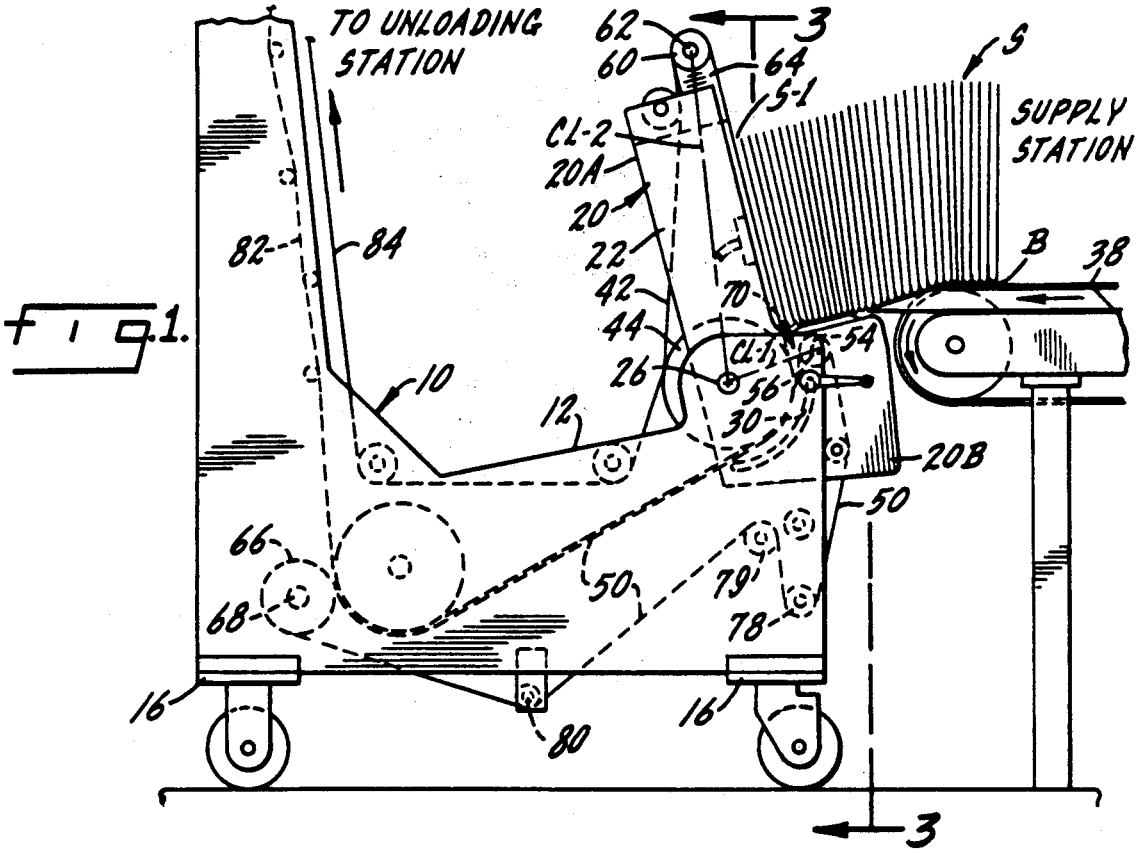
FIG. 1 is a side elevation of a signature loader constructed in accordance with the present invention, shown in one mode of operation.
Figure 3:
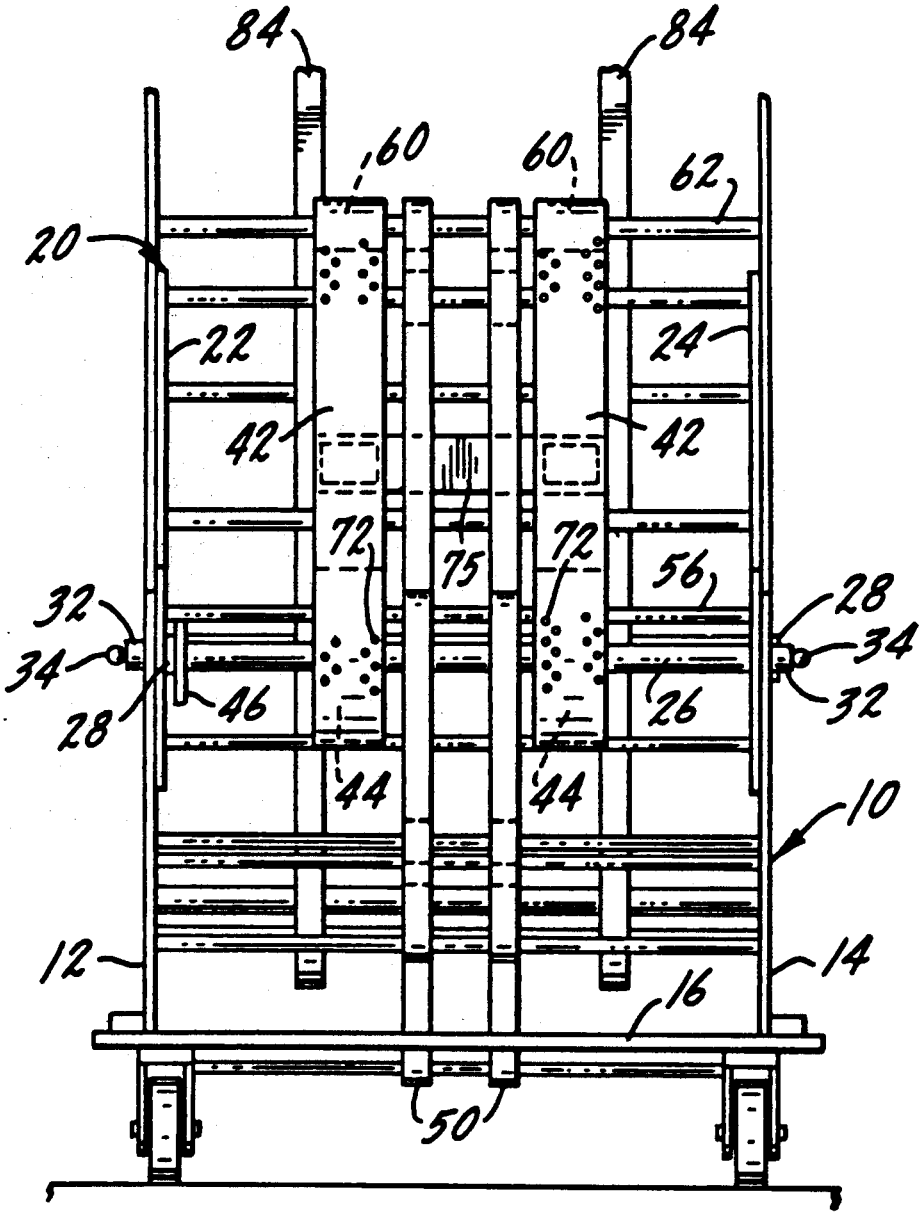
FIG. 3 is an end view on the line 3—3 of FIG. 1.

The signature loader shown in FIG. 1 has a main floor-mounted frame 10 which comprises a pair of laterally spaced vertical side plates 12 and 14, FIG. 3, rigidly joined by spacers as 16. A second or auxiliary frame 20 is located at one end of the main frame and comprises a pair of side plates 22 and 24, telescopically related to the main frame. Each side plate of the auxiliary frame is L-shaped, having a long leg 20A and a short leg 20B.

The auxiliary frame is pivotally supported by a first horizontal shaft 26, FIG. 3. This is a driven shaft for reasons to be explained. Suitable bushings and bearings 28, FIG. 3, are employed to support shaft 26, transversely of and between the frames; nonetheless the auxiliary frame is rigidly clamped to the main frame, either in the attitude shown in FIG. 1 or the attitude shown in FIG. 3. Different forms of manually operable clamps may be employed, but the preferred form is shown in FIG. 3. Thus, the auxiliary frame is provided with a radial slot 30, FIGS. 1 and 2. A manually operable clamp washer or bushing 32 has an exposed hexhead (not shown in detail) which may be released when the auxiliary frame is to be relocated, and when properly positioned, retightened by a handle 34.

The loader includes a hopper or magazine characterized by signature in-feeding support belting 38 (or equivalent driven conveyor) which advance the signatures by an index or incremental movement toward a bight or throat defined by opposed belting as will now be described.

The auxiliary frame supports a pair of endless infeeding belts which converge to capture the signatures advanced by the magazine or support belting 38. Thus, a pair of large infeeding belts 42, FIG. 3, are guided about a pair of corresponding rollers as 44, FIG. 1, secured to shaft 26. Those rollers are driven rollers, rotated constantly by a chain-driven sprocket 46 secured to one end of shaft 26 as shown in FIG. 3. Idler rollers reverse the belts 44 as will be explained.

Opposed to the belts 42 are a related pair of endless infeeding belts 50, best shown in FIG. 3. The opposed belts 50 are supported in part by idler rollers 54 on a second roller support shaft 56 extending between the side plates of the auxiliary frame.

The first set of large infeeding belts 42 have a short run, being reversed by idler rollers 60 on a third (idler) shaft 62 supported by brackets as 64 secured to the free end of the auxiliary frame.

The second set of infeeding belts 50 have a long run across the bottom of the main frame to a pair of driven rollers as 66 on a sprocket driven (fourth) shaft 68, FIG. 1, supported for rotation on the main frame. Tensing and slack-take-up rollers for the belts 50 intervene as can be readily seen in both FIGS. 1 and 2.

From the standpoint of whether driven or idler, the four shafts of course can be reversed. Large belts may be employed, instead of a pair; or either pair of belts may be enlarged to include a third or fourth. In any event, the main principle of the invention is that the center lines CL-1 and CL-2 joining the first and second shafts 26 and 56, and the first and third shafts 26 and 62 do not change when the auxiliary frame is tipped from one attitude to the other, as can be seen from comparing FIGS. 1 and 2; nor does the distance of the fourth shaft 68 change compared to the others.

In FIG. 1, the signatures S constituting the supply are stacked on edge with the fold or backbone B engaged with the supporting or supply belting 38. Further, with the auxiliary frame locked in the position shown in FIG. 1, with the long leg of the auxiliary frame pointing up, the belts 42 and 50 converge to define a gate or throat 70 into which the backbone of forwardmost signature S-1 is aligned. Preferably the infeeding belts 42 are such as to grab the forwardmost signature by suction. To this end, the belts 42 are provided with openings or apertures 72, FIG. 3, traversing a constant source of vacuum afforded by a vacuum manifold 75. In this manner, the leadingmost signature is stripped from the supply in the hopper and forced into the throat 70 defined by the convergence or confluence of the opposed infeeding belts 42 and 50.

Figure 2:
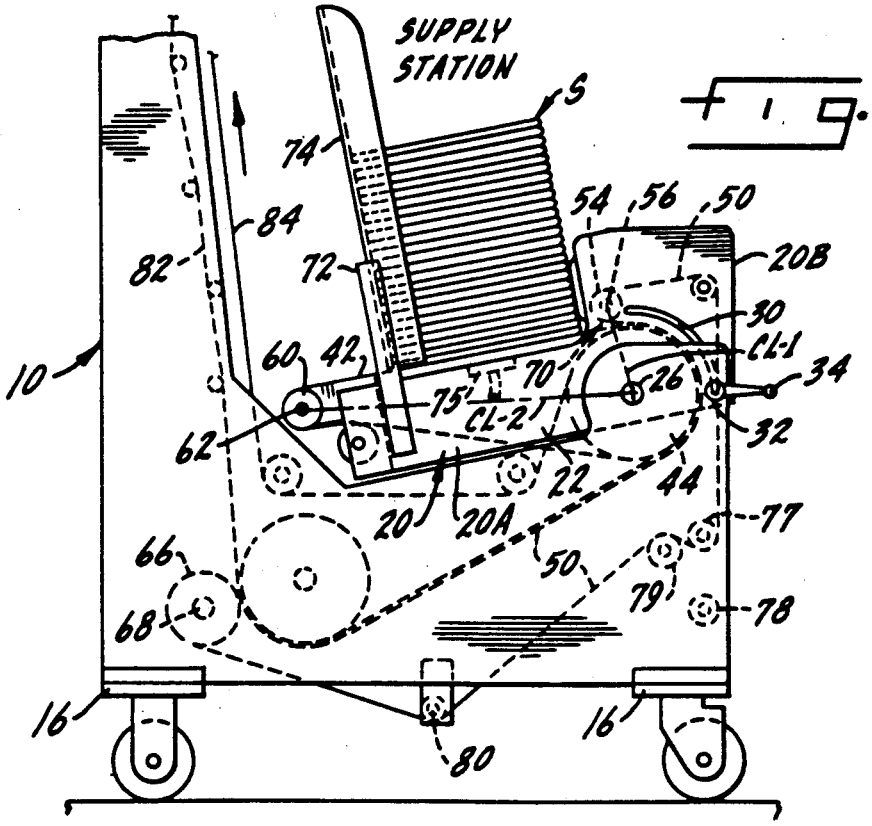
FIG. 2 is a side elevation of the same loader in its other mode of operation.

If, on the other hand, the signatures are received from the printing press room in a vertical stack, FIG. 2, then the lock structure 32–34 is loosened and the auxiliary frame rotated counterclockwise from the FIG. 1 to the FIG. 2 position.

The vertical stack, one signature atop another, FIG. 2, will ordinarily require a back support frame 72, 74. In this arrangement, FIG. 2, the backbones of the signatures again are pointed at the infeed throat 70 defined by the convergence of the belts 42 and 50.

There may be some slack in the belting 50 when changing the position of the auxiliary frame. This is easily accommodate by spacing the idlers 77, 78 and 79 for the belting 50, or by taking advantage of adjustable idlers as 80.

Again referring to FIG. 2, the backbones of the signatures face the infeed throat 70 as noted. Now, it is the bottommost of the signatures advanced to the throat 70 by the suction belts 42.

Additional belting is provided for leading the signatures in an overlapped or imbricated stream from the supply station to the unloading station by opposed belts 82 and 84.

The preferred embodiment has been illustrated and described, particularly in terms of the unchanging separation between the first and third roller shafts 26 and 56, and their associated second and fourth roller shafts 62 and 68, when rotating the auxiliary frame about the pivot supported by the main frame, preferably the axis of the driven roller shaft 26. The organization of the belting may be varied and of course the lock may take different forms.

I claim:

1. A signature loader for feeding signatures between a supply station and an unloading station, comprising a telescopically related main floor-mounted frame and a smaller auxiliary frame, a first and second horizontal rotatable shafts extending within both frames with the axes of the shafts spaced apart by a predetermined distance, said shafts respectively supporting rollers for opposed infeed belts and so positioned that the infeed belts thereon converge to define between them an infeed entry bight or throat into which the signatures are to be fed one by one from the supply station and advanced by said belts in the direction of the unloading station, one of said shafts also constituting a pivotal axis about which the auxiliary frame may be pivoted so that said throat may be selectively positioned in one of two alternate attitudes to receive signatures by either a substantially vertical drop into the throat or by a substantially horizontal movement of the signatures into the throat, and a manually settable lock by which the two frames are rigidly joined with the said throat in one attitude, whereby upon releasing the lock the auxiliary frame may be turned on said axis to locate the throat in its other attitude.

2. A signature unloader according to claim 1 in which the auxiliary frame supports a third transverse shaft on which is located a third roller spaced from and associated with the roller on said first shaft with one of the infeed belts supported by and between the first and third rollers.

3. A signature unloader according to claim 2 in which the main frame supports a fourth transverse shaft on which is located a fourth roller spaced from and associated with said second shaft with the other of the infeed belts supported by and between the second and fourth rollers.

4. A signature unloader according to claim 3 in which the first and fourth shafts and the rollers thereon are driven and in which the second and third shafts support idler rollers.

5. A signature unloader according to claim 4 in which the infeed belt supported by and between the rollers on the first and third shafts is apertured with the apertures communicating with a source of negative pressure to capture the supply signatures successively by suction to feed the signatures to the throat.

* * * * *